US008207434B2

(12) United States Patent
Klemp

(10) Patent No.: US 8,207,434 B2
(45) Date of Patent: Jun. 26, 2012

(54) ENCLOSURE FOR A MUSICAL INSTRUMENT

(76) Inventor: Michael W. Klemp, Homer Glen, IL (US)

( * ) Notice: Subject to any disclaimer, the term of this patent is extended or adjusted under 35 U.S.C. 154(b) by 4 days.

(21) Appl. No.: 12/906,629

(22) Filed: Oct. 18, 2010

(65) Prior Publication Data

US 2011/0088532 A1 Apr. 21, 2011

Related U.S. Application Data

(60) Provisional application No. 61/253,635, filed on Oct. 21, 2009.

(51) Int. Cl.
*G10D 9/00* (2006.01)

(52) U.S. Cl. ..... 84/453; 206/314

(58) Field of Classification Search ..... 84/453; 206/314; D3/204

See application file for complete search history.

(56) References Cited

U.S. PATENT DOCUMENTS 6,441,288 B1 * 8/2002 Lin ..... 84/453
2003/0192795 A1 * 10/2003 Izen et al. ..... 206/314
2003/0214202 A1 * 11/2003 Gembar et al. ..... 312/114

* cited by examiner

*Primary Examiner* — Jianchun Qin
(74) *Attorney, Agent, or Firm* — Banner & Witcoff, Ltd.

(57) ABSTRACT

An enclosure is provided for a musical instrument, particularly for a guitar. The enclosure has a flexible rear panel having a laterally enlarged lower portion to cover the back side of the guitar. The enclosure further includes a flexible front side being substantially of the same size and shape as the rear side of the enclosure. A side panel, which is substantially continuous, interconnects the rear side and the front side of the enclosure. Preferably, the front side is clear or transparent so that the guitar may be viewed from outside the enclosure. An opening is provided in the bottom of the side wall and the opening is sized and shaped to allow the passage of the guitar in and out of the enclosure.

10 Claims, 3 Drawing Sheets

ENCLOSURE FOR A MUSICAL INSTRUMENT

CROSS REFERENCE TO RELATED APPLICATION

This is a utility application based on provisional application Ser. No. 61/253,635 filed Oct. 21, 2009 entitled "Enclosure for a Musical Instrument" for which priority is claimed.

BACKGROUND OF THE INVENTION

This invention relates to enclosures for musical instruments, particularly guitars, when the instrument is not being used.

When a musical instrument, such as a guitar, is not being used, it may be placed on a stand to hold the instrument in an upright position. When it rests unused for a period of time, the instrument will collect dust from the air that circulates in the room. Dust can collect on the fret board, on the body, on the strings and can even pass into the interior through the sound hole. It is possible for dust to find a way into the electronic pick ups and controls of the guitar. All of this is clearly undesirable.

Guitars are of different types, such as acoustic guitars, classical guitars, hollow body electric guitars and solid body electric guitars. Older, high quality guitars are known to be collectors' items and are highly prized. Furthermore, many musicians and collectors of guitars have multiple guitars. Many guitars such as Gibson or Fender guitars may have a value of tens of thousands of dollars. As a consequence, guitar owners may seek methods and devices to protect their instrument such as by use of a guitar dust cover.

One known guitar dust cover is shown in U.S. Pat. No. 6,441,288. In this patent, a guitar cover is provided that is tent or teepee shaped and is designed to have the instrument covered such as when resting in an upright position on a support stand. Although the disclosed cover does offer some protection for the guitar from dust collection, the cover does not allow for viewing by the musician or owner of the guitar, particularly when it may be a collectors' item. The guitar cover of the '288 patent does not have a provision for viewing the guitar, such as a clear panel or flexible window for viewing. The owners of multiple guitars thus need to open multiple protective covers to locate the particular guitar that they wish to play or display for viewing by third parties.

Therefore, a need exists to provide an enclosure or cover for guitars or other such musical instruments wherein the cover not only protects the guitar from unwanted handling and dust collection on the guitar, but to also allow the instrument(s) to be viewed by the musician or displayed to third parties.

SUMMARY OF THE INVENTION

An enclosure is provided for a guitar by a continuous, flexible rear panel which has an enlarged lower portion that covers the back side of the guitar and has a narrowed upper portion for covering the back side of the neck portion and the head portion of the guitar or other musical instrument. A continuous, flexible front panel is provided with an enlarged lower portion for covering the front side of the instrument and has a narrowed upper portion for covering the front side of the neck portion and the head portion. The front panel and the rear panel are substantially of the same size and shape, typically congruent. A provision is made for interconnecting the front and rear panels in order to form the enclosure, such as a continuous side panel. The front panel, the side interconnecting means, and the rear panel all cooperate to protect the musical instrument from dust accumulation. One panel, preferably the front panel, is made of a generally transparent or clear, flexible material and enables the enclosure to protect the musical instrument from dust accumulation while the transparent panel allows the musical instrument or guitar to be displayed or viewed and easily identified by the owner and/or viewed by third parties without opening the enclosure. Provision is made on the enclosure for allowing the guitar to readily be passed in and out of the enclosure from an opening provided in the bottom of the enclosure, specifically in the bottom of the side wall.

BRIEF DESCRIPTION OF THE DRAWING

Referring to the drawings.

DETAILED DESCRIPTION OF ONE EMBODIMENT

Figure 1:
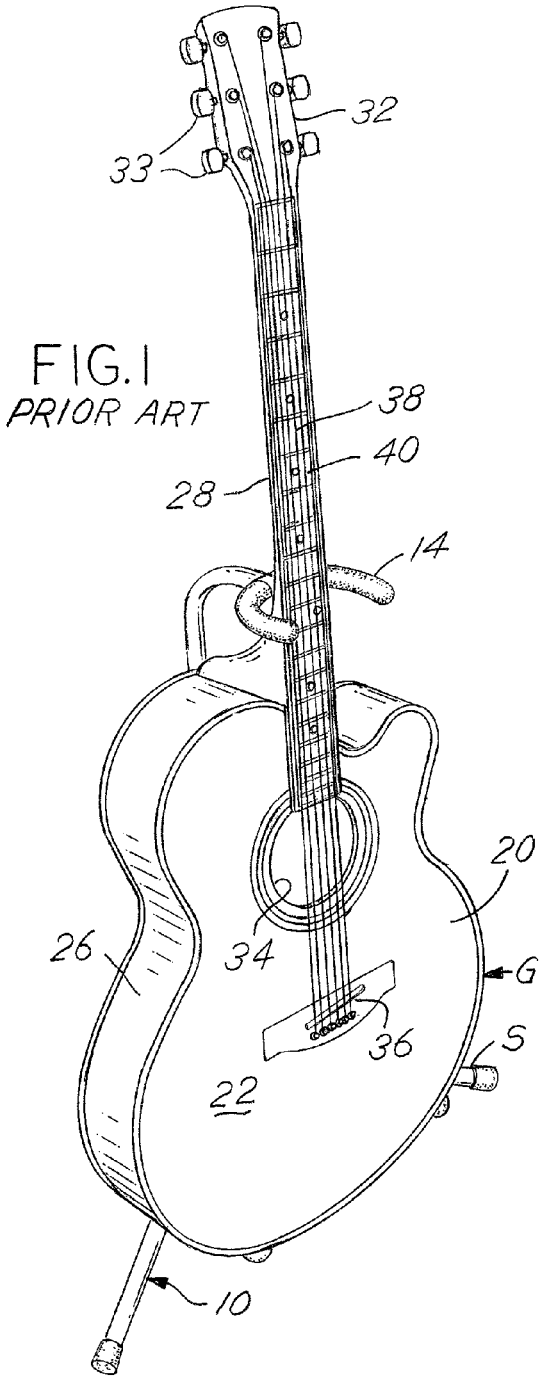
FIG.1 PRIOR ART
FIG. 1 is a prior art, front perspective view of a guitar resting on a support stand for a guitar.
Figure 2:
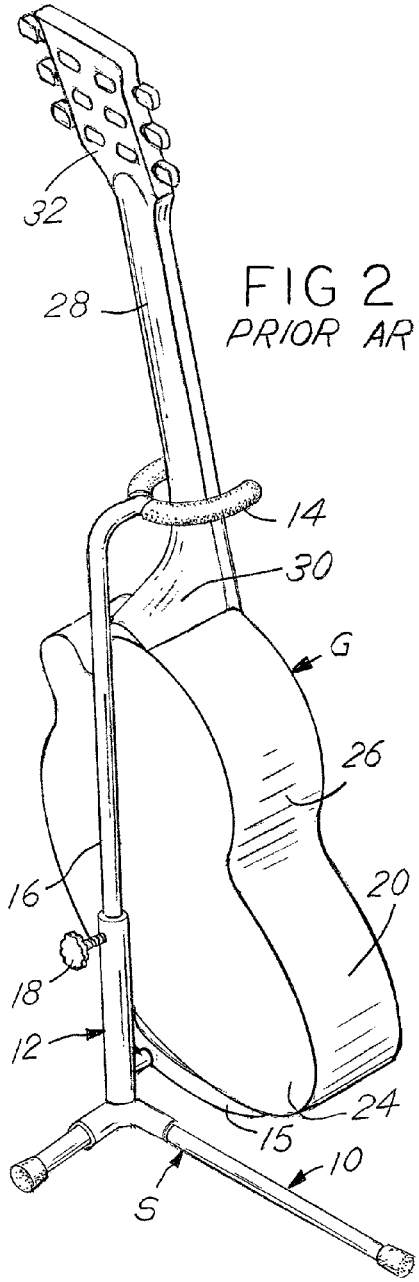
FIG 2 PRIOR ART
FIG. 2 is a prior art, rear perspective view of the guitar of FIG. 1 resting upon the guitar stand.

Referring to FIGS. 1 and 2, a guitar G is shown supported on a support stand S for the guitar G. Both the guitar G and the support stand S are generally known in the prior art. The guitar stand S includes a base generally 10, shown with a conventional lower tripod base 12. An upright support column 12 extends upwardly from the base 10. As seen best in FIG. 2, a lower support 15, generally bow shaped, extends outwardly from the base and supports the bottom of the guitar G. An upward tubular shaft 16 extends upwardly from the support column 12. A thumbscrew 18 is threadably secured to the tubular section 16 and allows the upright shaft 12 to be adjusted in height relative to the height of the guitar G. The upper end of the column 12 includes an outwardly directed support arm 14 having a forward upper end which supports the neck of the guitar. Those skilled in the art realize the enclosure design to be described may be used with other types of support stands for musical instruments.

Referring to FIGS. 1 and 2, the guitar G includes a lower, enlarged body portion, generally 20, having a front side 22, and a back side 24 which is generally of the same size and shape as the front side 22 of the body portion 20. The front side 22 of the body portion 20 and the back side 24 of the body portion 20 are interconnected by a continuous enclosed side wall 26 which extends completely around the periphery of the body portion to thereby securely interconnect the front side 22 and the back side 24 of the guitar G. A neck portion 28 of the guitar G, as seen best in FIG. 2, is reduced in size relative to the body 20 and is secured at the top end of the side wall 26 of the body portion 20 by means of a conventional heel or head stock 30. The neck portion 28 extends upwardly and terminates at a head portion 32. The front side of the body portion 20 includes a sound hole 34 in a conventional manner. Below the sound hole and generally central of the front body portion 22 a bridge 36 is provided. The head portion 32 carries multiple tuning keys 33 that are threadably carried on the head 32. Multiple strings 38 are secured to a bridge 36 on the front side of the body portion 22. The upper end of the strings 38 is secured to the tuning keys 33 that are carried on the head of the guitar G. The front of the neck portion 28 carries an elongated finger board 40, in a conventional manner.

While the guitar G is shown as one type of guitar, it is to be understood that the enclosure, generally 50, to be described hereinafter, may be used in connection with a wide variety of musical instruments, although the enclosure 50 is particularly intended to protect a guitar of various types. The guitar G may be of many different sizes. Most guitars have a height of between 40 and 50 inches. The depth of a classical or acoustic guitar may be in the range of 4-5½ inches. An electric hollow body guitar is much thinner and may be only 2 inches in depth. The width of guitars may be in the range of 16-18 inches, and the head 32 may average 4-6 inches in width. The particular dimensions and shape of the enclosure 50 may be varied widely to accommodate different guitars and other similar musical instruments.

Figure 3:
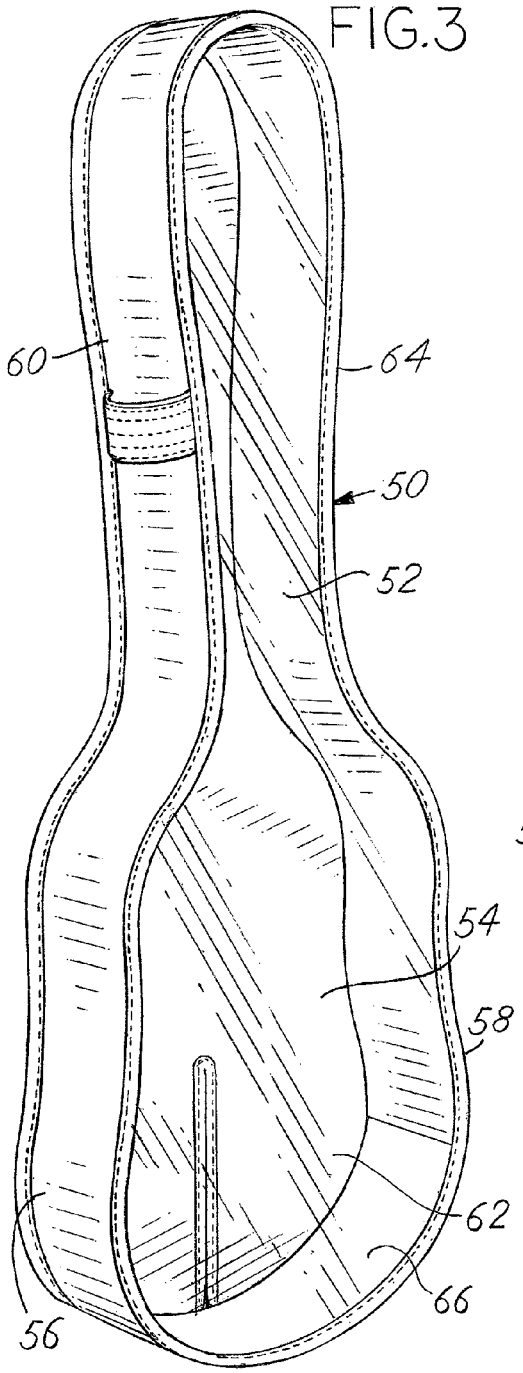
FIG. 3 is a front perspective view of the enclosure for a guitar of the type shown in FIGS. 1 and 2 embodying the invention.
Figure 4:
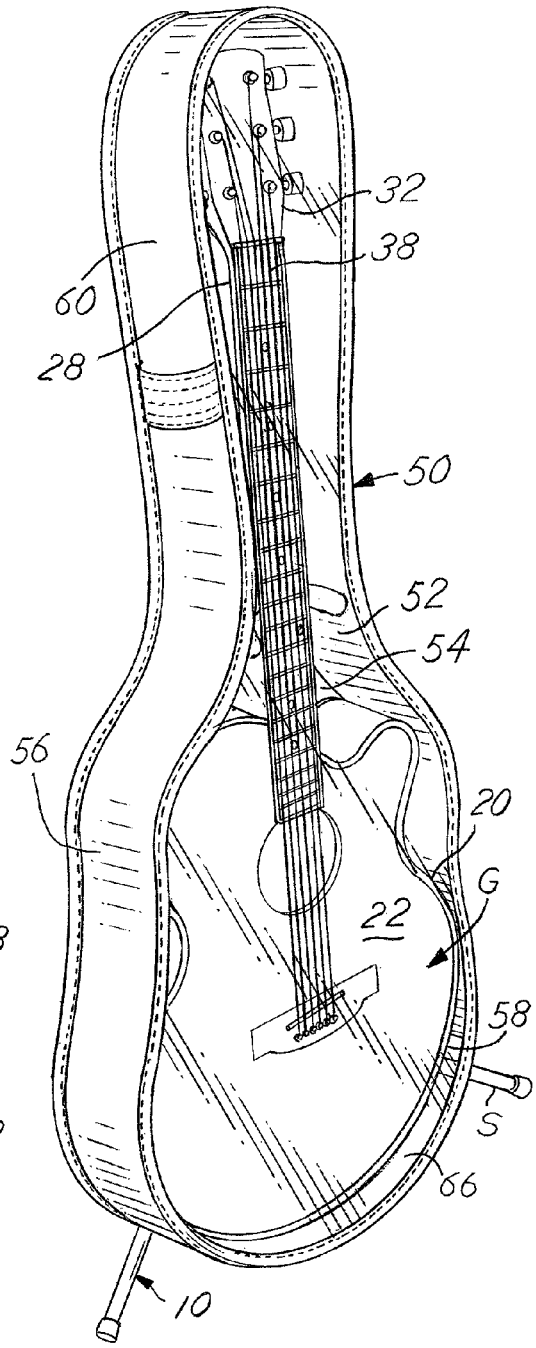
FIG. 4 is a front perspective view of a guitar shown within the inventive enclosure of FIG. 3.
Figure 5:
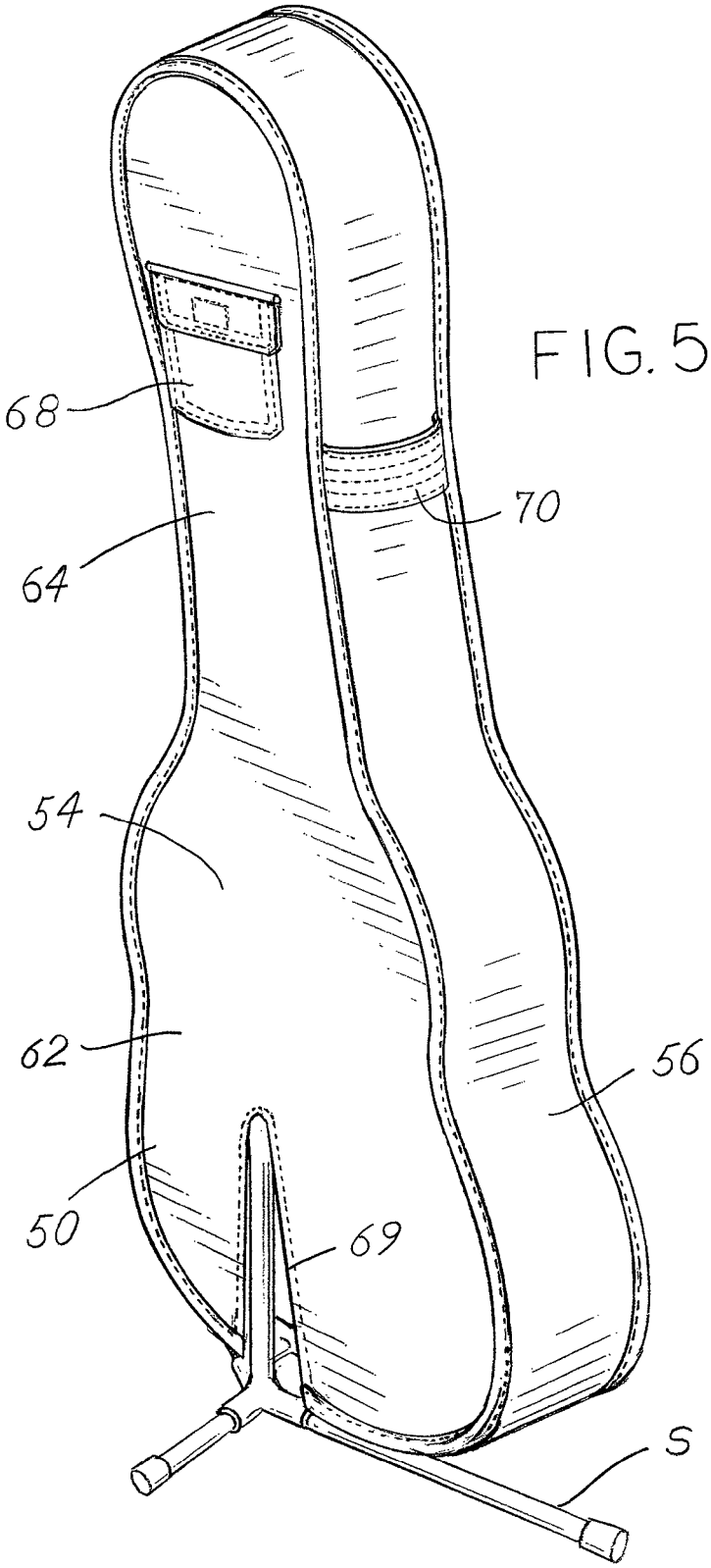
FIG. 5 is a rear perspective view of the enclosure for a guitar as shown in FIGS. 3 and 4.

Referring to FIGS. 3, 4 and 5, the guitar enclosure 50 includes a front side, generally 52, a rear side, generally 54, and a continuous side wall, generally 56, which interconnects the front side 52 and the rear side 54. The front side 52 of the cover 50 includes a lower, laterally enlarged portion 58 and a continuous upper portion 60 which is narrowed relative to the laterally enlarged lower portion of the front side 52. Similarly, the rear side 54 has a laterally enlarged lower portion 62 and a narrowed upper portion 64. The rear side 54 and side wall 56 are made of a soft material, such as cotton cloth, and lined with a thin foam pad to protect the surfaces of the guitar G from scratching when located in the enclosure. The interior of the enclosure 50 is made of the same soft material as the side 54 and side wall 56, without the foam padding.

In the embodiment shown in FIGS. 3-5, the continuous side wall 56 is preferably provided to interconnect the front side 52 to the rear side 54 of the cover or enclosure 50. It is to be understood, however, that a different embodiment (not shown) could be used wherein the front side and rear side are interconnected directly, such as by stitching (not shown). The side wall 56 encloses the outer periphery of the enclosure 50 and interconnects the front side 52 to the rear side 54. As shown in FIG. 3, preferably, an exit and entrance opening 66 is provided at the bottom of the side wall 56 so as to enable the cover 50 to be slipped over the top of the guitar G for enclosing the guitar and the guitar G may be removed from the enclosure 50 by passing the enclosure 50 over the guitar G. The opening 66, as shown and described, avoids the need for zipper or Velcro fasteners which could possibly scratch or damage components of the guitar when being inserted into or removed from the enclosure. However, the front side 52 may be removably secured to the side wall 56 by a Velcro fastener (not shown) or by a plastic zipper (not shown) but any such fastener is designed so as not to scratch or otherwise damage the guitar G. The exit opening 66 is sized and shaped to enable the guitar G to be passed in and out of the enclosure 50 so the guitar G cannot be scratched or damaged in any way by movement of the guitar G whether being passed through the opening 66 or through the front of the enclosure 50 when the front side has been removed in an alternate embodiment.

As seen best in FIGS. 3 and 4, the front side 52 of the cover 50 is of a clear, flexible material, such as a clear vinyl. In this way, not only does the cover 50 protect the guitar G from dust or other air carried contaminants, but the clear front side 52 enables the guitar G to be viewed while the guitar G is being protected within the enclosure 50, as best seen in FIG. 4. In this way, the owner of the guitar G, or third parties, may view the instrument while at the same time, the cover 50, including the clear front side 54, protects the guitar from dust and other contaminants, and any undesired handling.

In designing the guitar cover 50, the cover can be sized to receive different sized guitars, as previously discussed. The entire cover 50 is contoured to receive the contoured shape of the instrument. Preferably, the height of the guitar cover may vary between 46 and 56 inches. The depth of the cover 50 is in the range of 6 to 9 inches. The width of the guitar cover 50 varies from approximately 20 inches at the enlarged lower portions of the cover to a 6 inch width at the top for enclosing the neck portion and head portion of the guitar G.

In an embodiment, a pocket 68, as shown in FIG. 5, is provided on the cover 50 in a suitable location, such as on the rear side 54 as shown in FIGS. 4 and 5. In addition, two sewn handles 70 are secured to the opposite sides of the side wall 56 for ease of lifting and carrying. The pocket 68 may be used to store objects like picks or capos. Depending on the material used, small openings (not shown) may be provided in the cover, particularly at the lower portion thereof so that the humidity within the enclosure 50 is of substantially the same atmosphere as the exterior environment. A holder (not shown) may also be provided for a small guitar humidifier (not shown) in the interior of the cover 50. The use of breathable materials may also be used to eliminate the need for the humidifier. A slot 69 may be provided in the lower center of the rear side wall 54 to accommodate a guitar stand style having a rear support leg, as shown.

Other variations in the cover 50 may be provided. The front side 52 is preferably translucent for identification viewing for inspection by a TSA inspector when passing through an airport checkpoint, where the front side 52 may not be clear enough for detailed viewing. Also, the front side 52 may only be of a partially clear or translucent material to provide a window for viewing the guitar G while the remaining portion of the front side 52 may be of the same material as the rear side 54 and side wall 56. The front side 52 is preferably of a material that filters out UV rays to protect the guitar G from sun damage. Further, clear panels (not shown) may also be provided in selected areas of the front side 52, back side 54 and side wall 56. A removable separate outer cover panel (not shown) may be provided to cover the clear front side 52, for example, when the owner of the instrument is traveling. Finally, the back side 54 and side wall 56 may have rigid panels provided to further protect the instrument from physical damage.

The above detailed description is of one embodiment of the present invention. It will be recognized by one skilled in the art that the described embodiment may be altered or amended without departing from the spirit and scope of the invention as defined in the accompanying claims.

What is claimed is:

1. An enclosure for displaying and protecting a musical instrument from dust accumulation when not in use, said musical instrument being of the type which includes a laterally enlarged body portion having back and front sides interconnected by a side portion, a neck portion, narrowed relative to the body portion, and a head portion at the upper end of said neck portion, said enclosure comprising:

a continuous, flexible rear panel having an enlarged lower portion for covering said back side of said musical instrument and having a narrowed upper portion for covering said back side of said neck portion and said head portion;

a continuous, flexible front panel having an enlarged lower portion with a lower end edge for covering said front side of said musical instrument and having a narrowed upper portion for covering said front side of said neck portion and said head portion, said rear panel and said front panel being of substantially the same size and shape;

a side panel for interconnecting said front and rear panels for forming said enclosure, said front panel, said back panel and said side panel cooperating to enclose and protect said musical instrument from dust accumulation said front and rear panels configured and sized to the contoured shape and size of the instrument;

at least one of said front and rear panels being at least partially transparent for enabling said enclosure to both protect said musical instrument from dust accumulation while allowing said musical instrument to be viewed from the exterior; and a slit opening provided on the enclosure intermediate the lower end edge of the front panel and the side panel, said slit opening sized and configured to allow passage of the musical instrument in and out of the enclosure without contact of the instrument by fasteners for closing the slit.

2. The enclosure of claim 1 wherein at least one exterior handle member is provided on one of said panels.

3. The enclosure of claim 1 wherein said one clear panel is said front panel and is completely clear.

4. The enclosure of claim 1 wherein the rear panel includes a lower edge and a laterally enlarged lower portion, said laterally enlarged lower portion including a slot on the outside face of said rear panel extending from said lower edge for receipt of a support leg.

5. The enclosure of claim 1 wherein one of said rear panel and said front panel is in part rigid.

6. The enclosure of claim 5 wherein at least one of said panels includes an inside surface at least in part including a protective padding material.

7. The enclosure of claim 5 wherein at least one of said panels includes an inside surface at least in part including a protective padding material;

wherein said side panel is secured at least in part to the periphery of both said front panel and said rear panel;

wherein said one panel is said front panel and is completely clear; and wherein the rear panel includes a lower edge and a laterally enlarged lower portion said laterally enlarged lower portion including a slot on the outside face of said rear panel extending from said lower edge for receipt of a support leg.

8. The enclosure of claim 1 wherein at least one of said panels includes an inside surface at least in part including a protective padding material.

9. A display assembly for a musical instrument having an enlarged bottom portion and an upper portion, said display assembly comprising, in combination, a support for supporting a musical instrument in an upright position, said support comprising a base, an upright support portion extending upwardly from said base, a lower member extending outwardly from said base; and an enclosure for protecting a musical instrument from dust accumulation and for viewing, said musical instrument being of the type which includes an enlarged bottom portion having back and front sides interconnected by a side portion, a neck portion, narrowed relative to the body portion, and a head portion at the upper end of said neck portion, said musical instrument being contained within said enclosure, said enclosure having a continuous rear panel having an enlarged lower portion for covering said back side of said musical instrument and having an upper portion for covering said back side of said neck portion and said head portion said enclosure having a continuous flexible front panel with an enlarged lower portion with a bottom edge, said lower portion sized for covering said front side of said musical instrument and having a narrowed upper portion for enclosing said front side of said neck portion and said head portion, said rear panel and said front panel being of substantially the same size and shape, and a side panel interconnecting said front and rear panels for forming said enclosure;

said front panel, said back panel and said rear panel cooperating to enclose and protect said musical instrument from dust accumulation, said front panel being at least partially transparent for allowing said musical instrument to be displayed for external viewing;

a slit opening provided in the enclosure along said bottom edge of said front panel for allowing passage of the musical instrument in and out of said enclosure; and said enclosure with said musical instrument further including a slot extending from a lower exterior edge of said rear panel toward the upper portion thereof, said upright support portion of said support positioned in said slot whereby the enclosure and a musical instrument therein are supported by said support stand, said lower member of said base, said upper member of said base supporting said enclosed musical instrument in a substantially upright position allowing for viewing of said musical instrument through said at least partially transparent panel of said enclosure.

10. The display assembly of claim 9 wherein said musical instrument is a guitar.

* * * * *